United States Patent [19]

Bege et al.

[11] 4,424,149

[45] Jan. 3, 1984

[54] METHOD FOR ULTIMATE DISPOSITION OF BORATE CONTAINING RADIOACTIVE WASTES BY VITRIFICATION

[75] Inventors: Dietmar Bege, Erlangen; Hans-Joachim Faust, Grossgeschaid; Anwer Puthawala; Helmut Stünkel, both of Erlangen, all of Fed. Rep. of Germany

[73] Assignee: Kraftwerk Union Aktiengesellschaft, Mülheim, Fed. Rep. of Germany

[21] Appl. No.: 271,822

[22] Filed: Jun. 9, 1981

[30] Foreign Application Priority Data

Jun. 20, 1980 [DE] Fed. Rep. of Germany ..... 3023183
Jul. 16, 1980 [DE] Fed. Rep. of Germany ..... 3026968

[51] Int. Cl.[3] ..... G21F 9/16
[52] U.S. Cl. ..... 252/629; 252/626
[58] Field of Search ..... 252/629, 626

[56] References Cited

U.S. PATENT DOCUMENTS 4,119,561 10/1978 Drobnik et al. ..... 252/629
4,202,792 5/1980 Kaufmann et al. ..... 252/629
4,224,177 9/1980 Macedo et al. ..... 252/629

FOREIGN PATENT DOCUMENTS 1557261 12/1979 United Kingdom ..... 252/629

OTHER PUBLICATIONS

Gilmore, William, ed. 1977, Radioactive Waste Disposal–Low and High Level, Noyes Data Corporation, Park Ridge, New Jersey, pp. 75–77.

Casey, Leslie, ed. 1978 Proceedings from the Conference on "High Level Radioactive Solid Waste Forms", US Nuclear Regulatory Commission, Washington, D.C. p. 161.

Sanyal, A., and J. Mukerji 1974, Fixation of High Level Atomic Waste in Glass fo Ultimate Disposal: Part II--Development of Vitreous Matrices for the Containment of CIROS, Tarapur & Ramapratapsagar Fuel Reprocessing Wastes, J. Scient. Ind. Res. vol. 33: 436–460.

*Primary Examiner*—Deborah L. Kyle
*Assistant Examiner*—Howard J. Locker
*Attorney, Agent, or Firm*—Herbert L. Lerner; Laurence A. Greenberg

[57] ABSTRACT

Method for the ultimate disposition of radioactive wastes by vitrification, in which weak to medium radioactive waste concentrates from borate-containing radioactive liquids are mixed with added glass-forming materials, maximally in a ratio of 1:3, and the mixture heated to obtain a glass-forming melt.

2 Claims, No Drawings

METHOD FOR ULTIMATE DISPOSITION OF BORATE CONTAINING RADIOACTIVE WASTES BY VITRIFICATION

BACKGROUND OF THE INVENTION

1. Field of the Invention

The invention relates to a method for the ultimate disposition of radioactive wastes by vitrification.

2. Description of the Prior Art

Up to now, highly radioactive wastes were treated in this manner, i.e. by adding radioactive fission-product oxides from the reprocessing of radiated nuclear fuel materials, in small quantities of 5 to 20% of the glass quantity to the liquid glass. In other words, glass was produced from suitable components, and the fission product oxides were bound in the glass matrix.

SUMMARY OF THE INVENTION

The object of the present invention in contrast thereto, is to provide a method of disposing weak-to-medium active waste concentrates from borate containing radioactive liquids. Such liquids are generated especially in pressurized water reactors, because boron is used therein for controlling the activity. However, the amount of boron components accumulated thereby is relatively large. For example, 10 metric tons can be accumulated in the operation of a pressurized water reactor during one year.

With the foregoing and other objects in view, there is provided in accordance with the invention a method for ultimate disposition of radioactive wastes by vitrification, which comprises mixing radioactive waste concentrates from borate-containing radioactive liquids with added glass-forming materials, maximally in a ratio of 1 part by weight waste concentrates to 3 parts by weight glass-forming materials to form a glass composition in which the borate in said waste concentrate is an essential element in production of glass from the composition, and the glass composition heated to obtain a glass-forming melt.

Other features which are considered as characteristic for the invention are set forth in the appended claims.

Although the invention is illustrated and described herein as embodied in a method for ultimate disposition of borate containing radioactive wastes by vitrification, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

To dispose of the waste concentrates from borate containing radioactive liquids, the latter are mixed with glass-forming additional-materials, maximally in the proportion 1:3, and then heated so that a glass-forming melt is obtained. Thus, the borates which are to be removed, are themselves used as an essential component in the production of the glass. For this reason, the part of the waste materials with 30% or more by weight of the total glass mass is greater than at the known embedding of wastes in a "finished" glass matrix.

One can mix borate containing waste concentrates successfully with approximately 70 weight percent of lead oxide based on the combined weight of concentrate and lead oxide, and melt the mixture to lead-bortate-glass. A temperature of about 600° C. is especially suited for this purpose. The waste concentrates may by a pre-drying process before the mixing with the additional materials, be reduced to a residual moisture of 5% or less, so that the waste concentrates are mixed and heated with the additional materials practically without water. However, the waste material may also be used in its liquid form, and during the operation of melting to glass, evaporation first takes place, in which the water is removed. This "wet" type of mixture has advantages, because it avoids the danger of radioactive dust, and an intimate mixture of the waste and materials is obtained in a simple manner. The method according to the invention may be realized by mixing the borate-containing concentrate with about 50 weight percent silicates, and melting the mixture to form boron-silicate glass. For the silicates one can use, for example, natural silicates, i.e. clays, which mix especially well with liquid wastes. In experiments, a so-called "green clay", which is found in Neuwied, BRD, proved itself well. Here, the operating temperature was approximately 1000° C.

An electric glass melting furnace with a tight enclosure for containing the radioactive materials is advantageously used for supplying the heat required for the vitrification process.

In a further embodiment of the invention, ion-exchanger resins up to about 10 weight percent of the total mass are added to the waste and glass-forming material before the melting operation. Waste gases evolved during the melting process are drawn from the furnace and purified by passage through a gas-washer and/or a filter. Thereby, in addition to the borate-containing wastes which are used as the glass components, a transformation of ion exchanger resins is achieved. The amount of these resins that can be added, depends mainly on the permissible activity limit per barrel of waste, because this limit must conform to the storage regulations for low- or medium active wastes.

The melting process in the invention serves to eliminate the combustible components of the ion exchanger resins (radioactive resins). The following changes with respect to the resins take place sequentially:

1. Evaporation of water. In the case of drying the ion exchanger resins, only the residual water need be evaporated.

2. Combustion of the resins. This causes a volume reduction of about 90%, i.e. to about 10% of the original dry mass.

3. Melting of the residue during the formation of glass. The temperature is about 1000° C. when a boron-silicate glass is produced by the addition of the silicates. If a lead-boron glass is produced with lead additions, the melting temperatures are ordinarily about 600° C.

The method of the invention can advantageously be carried out in such manner that the melting process is repeated in steps without drawing off the molten products, i.e. a portion of a glass composition charge is fed into a vessel, the charge melted and later this is repeated with another portion, etc. until the vessel is filled to the desired height. The portions for each loading operation associated with one step are made up of components equal in proportion to components in another portion. The time of the steps is set to assure complete combustion of the combustible parts of the resins. In this step-process (discontinuous process), the process time is set to give 100% combustion of the resins. A time of 30 to 60 minutes will usually be adequate to effect combustion of the resins.

Since the waste gases from the melting furnace are purified, the method according to the invention for the disposition of radioactive ion exchanger resins, compared to the known method, for example by embedding in bitumen or cement, results in a smaller waste-volume, and in a product with excellent physical-chemical properties, especially with an outstanding stability with respect to leaching. The washing means for the gases and/or the filters for the purification of the exhaust gases represent a relatively low investment compared to the described advantages.

We claim:

1. Method for ultimate disposition of radioactive wastes by vitrification of weak-to-medium active concentrates containing boron together with ion exchange resins, which comprises mixing weak-to-medium active radioactive waste concentrates from borate-containing radioactive liquids with added glass-forming materials, maximally in a ratio of 1 part by weight waste concentrates to 3 parts by weight glass-forming materials, to form a glass composition in which the borate in said waste concentrate is an essential element in production of glass from the composition, before subjecting said glass composition to a melting operation, adding ion exchanger resins in an amount up to about 10 weight percent of the total mass, treating the resultant glass composition containing ion exchanger resins to obtain a glass-forming melt, and withdrawing and purifying waste gases evolved during said melting operation.

2. Method according to claim 1, wherein the method of vitrification is a discontinuous operation in which the components in the proportions making up the charge to be melted are intermittently introduced in portions into a vessel wherein each portion is heated for a sufficient length of time to obtain a glass-forming melt and effect complete combustion of the combustible parts of said resins, and wherein said procedure is repeated with other portions of the charge without discharging molten products from the vessel during the repeated chargings and meltings of the portions of charge.

* * * * *